US005379497A

United States Patent [19]

Nielsen et al.

[11] Patent Number: 5,379,497

[45] Date of Patent: Jan. 10, 1995

[54] APPARATUS FOR INSPECTING SETTINGS ON A TEXTILE FABRIC SHEARING MACHINE

[75] Inventors: Arne Nielsen; Phillip D. McCartney, both of Oak Ridge; Majid Moghaddassi, Greensboro, all of N.C.

[73] Assignee: Guilford Mills, Inc., Greensboro, N.C.

[21] Appl. No.: 108,342

[22] Filed: Aug. 18, 1993

[51] Int. Cl.[6] ..... D06C 13/00

[52] U.S. Cl. ..... 26/15 R; 26/70

[58] Field of Search ..... 26/70, 15 R, 17, 18, 26/7, 8 R, 9, 10 C; 33/630, 631, 632, 628, 640

[56] References Cited

U.S. PATENT DOCUMENTS

| | | | |
|---|---|---|---|
| 3,683,468 | 8/1972 | Kaufman | 26/15 R |
| 3,769,666 | 11/1973 | Kaufman | 26/15 R |
| 3,908,245 | 9/1975 | Büthe | 26/15 R |
| 3,941,986 | 3/1976 | Santucci | 26/17 |
| 3,969,797 | 7/1976 | Riedel et al. | 26/15 R |

*Primary Examiner*—Clifford D. Crowder
*Assistant Examiner*—Amy Brooke Vanatta
*Attorney, Agent, or Firm*—Shefte, Pinckney & Sawyer

[57] ABSTRACT

The relative dispositions of the shear cylinder, fabric rest and ledger blade of a textile fabric shearing machine may be inspected and any necessary adjustments thereof may be precisely measured and controlled by the present inspecting apparatus which comprises a linear guide rail mounted to the frame of the shearing machine in precise axially parallel relation to the shear cylinder and a carriage mounted on the rail for linear movement therealong, wherein the carriage is equipped with a detection tool, e.g., a feeler arm assembly, selectively articulable and manipulable into a plurality of dispositions for traveling surface contact with the fabric rest or ledger blade to detect and identify irregularities in linearity or relative disposition to the shear roll or to one another.

12 Claims, 3 Drawing Sheets

APPARATUS FOR INSPECTING SETTINGS ON A TEXTILE FABRIC SHEARING MACHINE

BACKGROUND OF THE INVENTION

The present invention relates generally to machines for shearing pile-type textile fabrics and, more particularly, to the inspection and adjustment of the relative settings of operative components of such machines.

The basic structure and operation of textile fabric shearing machines is well known and has not changed significantly in recent years. Basically, textile shearing machines have a machine frame on which a shear cylinder, typically equipped with a plurality of helically or spirally extending shear blades projecting outwardly from the cylinder periphery, is mounted for driven rotation. A traveling length of a pile or plush textile fabric is trained through the machine about a series of guide rolls and is presented to the rotating periphery of the shear cylinder for cutting of the pile surface of the fabric by passing the fabric over an elongate cloth or fabric rest which extends in a stationary disposition on the machine frame alongside the periphery of the cylinder. An elongate ledger blade is similarly mounted on the frame alongside the cylinder periphery adjacent the fabric rest. The ledger blade has an arcuate surface conforming to the periphery of the cylinder, which surface terminates at a sharpened edge extending in shear cutting relation along the periphery of the cylinder at a close spacing to the fabric rest. In operation, as a pile or plush fabric is passed over the fabric rest, the fabric rest acts to cause the plush or pile surface of the fabric to extend into the nip area between the cutting edge of the ledger blade and the peripheral cutting blades of the shear cylinder so as to be severed to a desired degree determined by the relative spacing and dispositions of the cylinder, ledger blade and fabric rest.

To ensure uniform shearing of the plush or pile surface of the fabric, it is important that the fabric deflecting surface or edge of the cloth rest and the cutting edge of the ledger blade be precisely linear and parallel both to one another and also to the axis of the shear cylinder. Otherwise, the surface of the fabric may be irregularly sheared to differing pile heights, producing second quality fabric or even rendering the fabric totally useless. While conventional shearing machines provide adjustment mechanisms by which the relative dispositions of the shear cylinder, the cloth rest and the ledger blade can be selectively adjusted, the adjustment mechanisms typically are relatively crude and uncalibrated and, further, it is difficult to accomplish uniformity in the relative dispositions of the cylinder, fabric rest and ledger blade across the entire width of the shearing machine.

SUMMARY OF THE INVENTION

It is accordingly an object of the present invention to provide an apparatus for use with a textile fabric shearing machine by which the relative dispositions of the shear cylinder, the fabric rest and the ledger blade can be precisely inspected across the entire width of the machine and, in turn, any necessary adjustments of these operating components can be precisely accomplished.

Basically, the inspection apparatus of the present invention is adapted for use in substantially any textile fabric shearing machine of the basic type comprising a frame, a shear cylinder rotatably mounted on the frame and having peripheral cutting blades, an elongate ledger blade stationarily mounted on the frame axially alongside the periphery of the cylinder in shear cutting relation with its cutting blades, and an elongate fabric rest stationarily mounted on the frame axially alongside the periphery of the cylinder at a lateral spacing relative to the ledger blade.

Briefly summarized, the present apparatus comprises a linear guide rail mounted to the frame of the machine in precise axially parallel relation to the shear cylinder and a carriage mounted on the rail for linear movement therealong. The carriage is equipped with a detection tool selectively positionable for traveling movement along the fabric rest or the ledger blade for identifying irregularities in linearity and irregularities in relative disposition to the shear roller and to one another. In addition, in the preferred embodiment, the carriage also has a measuring tool for determining the angle at which the cutting edge of the ledger blade is sharpened, as well as a grinding device for use in grinding the cutting edge of the ledger blade.

Preferably, the detection tool is in the form of a selectively articulable arm which can be manipulated into a plurality of differing dispositions for surface contact with the fabric rest or the ledger blade, and has an indicator for displaying a visual indicia of a detected irregularity, e.g., a visual dial or gauge which reacts to a deflection of the detection tool.

To enable the apparatus to be moved between and utilized with a number of differing shearing machines, brackets may be mounted to the frame of each machine at opposite sides thereof and the brackets and guide rail may be configured to be selectively matable with one another for mounting and demounting of the guide rail to and from a position on the frame in axially parallel relation to the shear cylinder.

The grinding device preferably includes a rotatable grinding wheel and a drive connectable to a source of pressurized air for driving rotation of the grinding wheel. A calibrating mechanism may be provided on the carriage to enable selective adjustment of the orientation of the grinding wheel as well as selective adjustment of the orientation of the measuring tool.

DETAILED DESCRIPTION OF THE PREFERRED EMBODIMENTS

Figure 1:
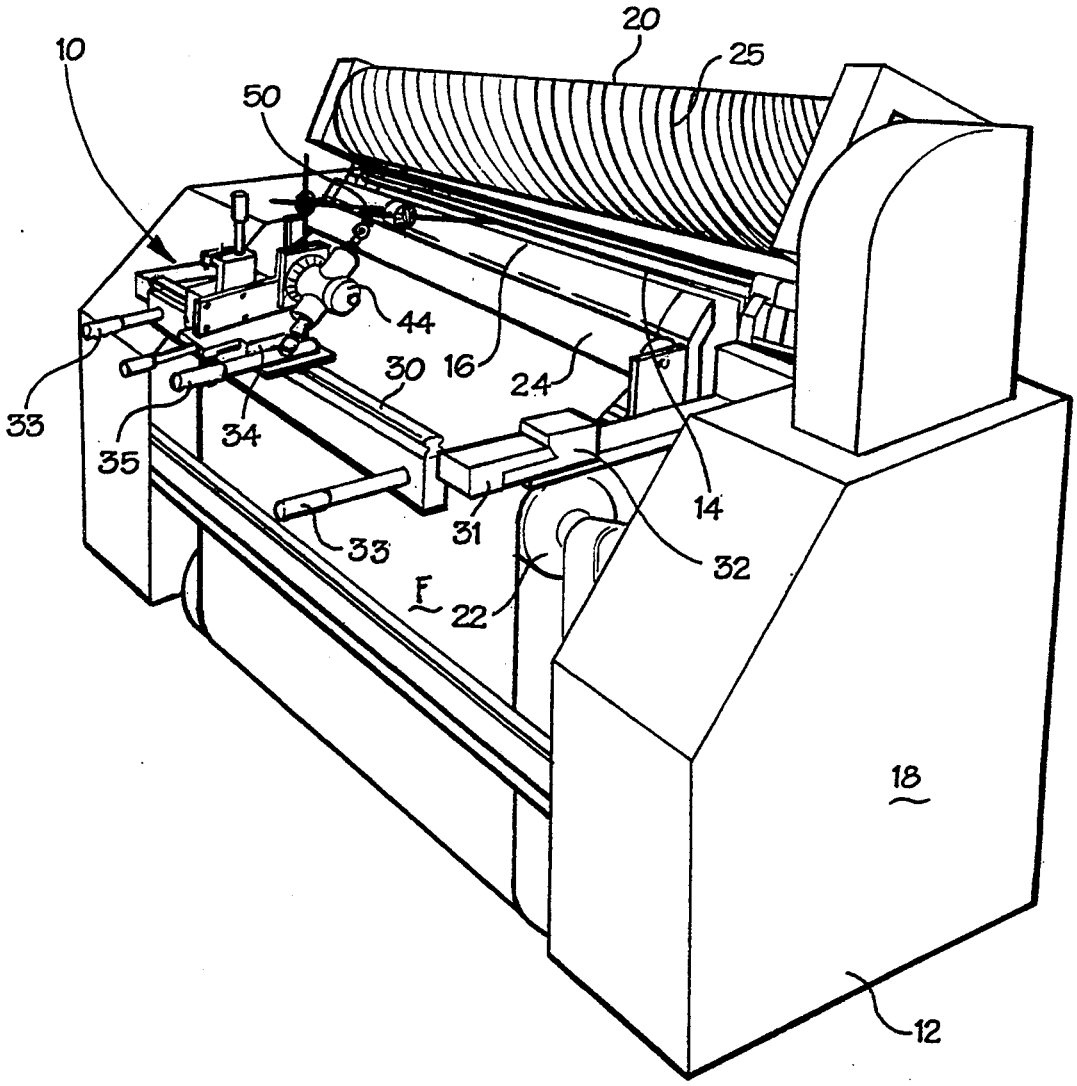
FIG. 1 is a perspective view of the preferred embodiment of the inspecting apparatus of the present invention, mounted in operative disposition on a conventional textile fabric shearing machine.

Referring now to the accompanying drawings and initially to FIG. 1, the inspection apparatus of the present invention is shown generally at 10 as mounted on a conventional textile shearing machine 12 for use in inspecting and adjusting the settings of the machine's ledger blade 14 and cloth rest 16, as more fully described hereinafter.

As is conventional, the shearing machine 12 has a machine frame 18 rotatably supporting a driven shearing cylinder 20 extending widthwise across the machine 12 directly above the ledger blade 14. The cloth rest 16 extends across the width of the machine frame 18 immediately forwardly of the ledger blade 14 at a close spacing thereto. Guide rolls, such as indicated at 22,24, train a fabric to travel from a supply roll (not shown) through the shearing machine 12 upwardly over the forward side of the cloth rest 16, then downwardly through the spacing between the cloth rest 16 and the ledger blade 14, and therefrom over additional guide rolls (not shown) to a take-up roll (also not shown).

Figure 2:
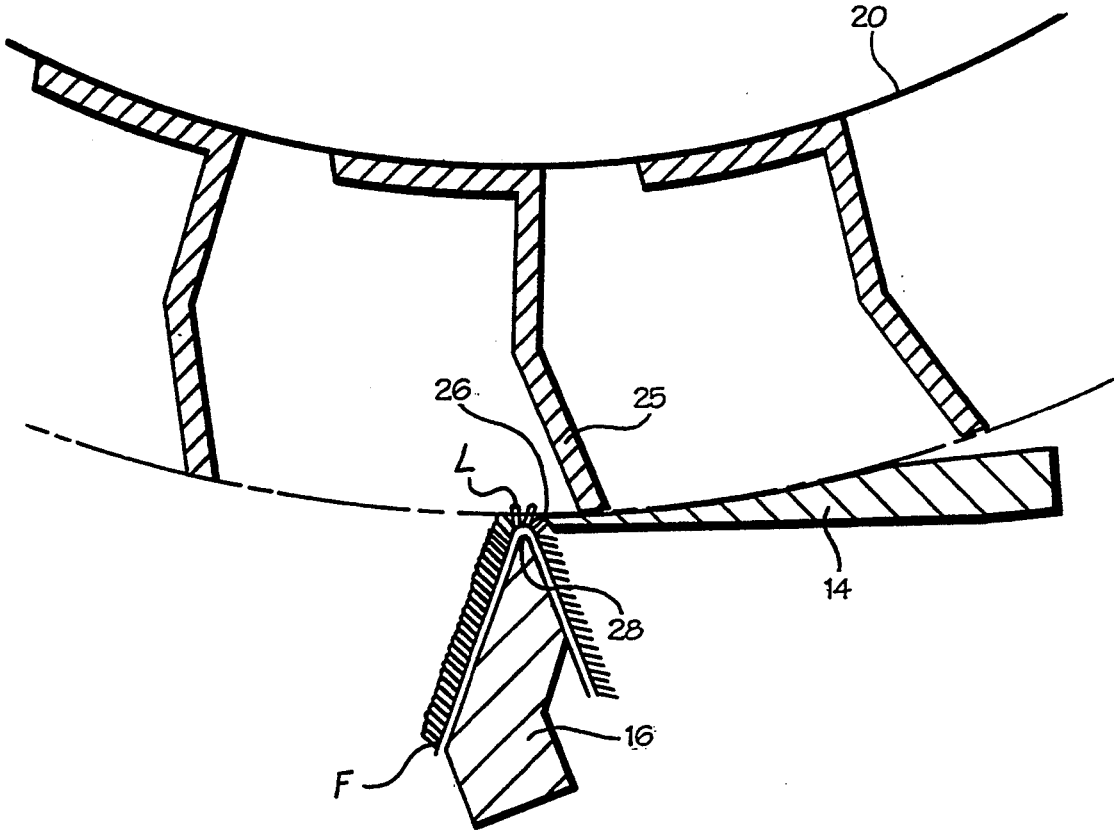
FIG. 2 is a cross-sectional view taken vertically through the shear cylinder, cloth rest and ledger blade of the shearing machine of FIG. 1, depicting the operational relationships of such components.

The shearing cylinder 20 carries a plurality of spirally extending cutting blades 25 extending outwardly over the entire peripheral circumference of the cylinder. As best seen in FIG. 2, the forward side of the ledger blade 14 is formed with an upwardly facing longitudinal cutting edge 26 extending immediately adjacent the periphery of the shearing cylinder 20 to be in shear cutting relation with its entire length, the upwardly-facing surface of the ledger blade 14 rearwardly of the cutting edge 26 being formed with an arcuately concave curvature conforming to the peripheral circumference of the shearing cylinder 20. The cloth rest 16 is of a tapered cross-section narrowing upwardly to a longitudinal deflecting nose 28 extending at a close forward spacing from the cutting edge 26 of the ledger blade 14. In basic operation, as illustrated in FIG. 2, as the fabric is deflected over the nose 28 of the cloth rest 16, the pile loops L of the fabric F are projected into the path of the cutting blades 25 on the shearing cylinder 20 and are cut by the shearing action between the cylinder blades 25 and the cutting edge 26 of the ledger blade 14.

As is known and understood, the cutting edge 26 of the ledger blade 14 and the deflecting nose 28 of the cloth rest 16 should be precisely linear and also should be oriented in precise parallel relation both to one another and to the axis of the shearing cylinder 20. In order to control the relative disposition of these operating components, the shearing machine 12 is provided with adjustment mechanisms by which the relative orientation of the operating components can be adjusted, but the typical conventional shearing machine provides no calibrations or other reference device or means for reference purposes in controlling the use of such adjusting mechanisms.

The inspecting apparatus 10 of the present invention enables this deficiency of conventional shearing machines to be overcome. As shown in FIG. 1, the inspecting apparatus 10 basically includes a linear guide rail 30 mountable and demountable to and from the forward side of the machine frame 18 by a pair of brackets 31 rigidly affixed to opposite ends of the rail 30 which in turn mate with another pair of brackets 32 rigidly affixed to the opposite ends of the frame 18, the brackets 32 being positioned to support the guide rail 30 precisely in parallel relation to the axis of the shear cylinder 20. A pair of handles 33 extend outwardly from opposite ends of the guide rail 30 to assist in handling of the guide rail 30 during installation and removal to and from the machine.

The upper surface of the guide rail 30 has a profiled configuration and a carriage 34 is mounted on the guide rail 30 by a bearing base portion 36 mating with the profiled configuration of the guide rail 30, for linear reciprocating movement of the carriage 34 back and forth along the length of the guide rail 30. A handle 35 extends outwardly from the base portion 36 for manually actuating movement of the carriage 34 lengthwise along the guide rail 30.

The carriage 34 includes a main frame 38 extending in upstanding relation from the bearing base portion 36. A subframe 40 is selectively attachable by thumb bolts 42 to either opposite side face of the main frame 38 to extend forwardly therefrom in cantilevered fashion toward the shearing components of the shearing machine 12.

The outward end of the subframe 40 also carries a rotatable dial 42 to which a cylindrical hub assembly 44 is coaxially mounted to extend outwardly therefrom. The subframe 40 and the dial 42 carry calibrated markings 46 by which the rotational disposition of the dial 42 and the cylinder hub assembly 44 can be precisely adjusted relative to the subframe and main frame 38,40 of the carriage 34.

Figure 3:
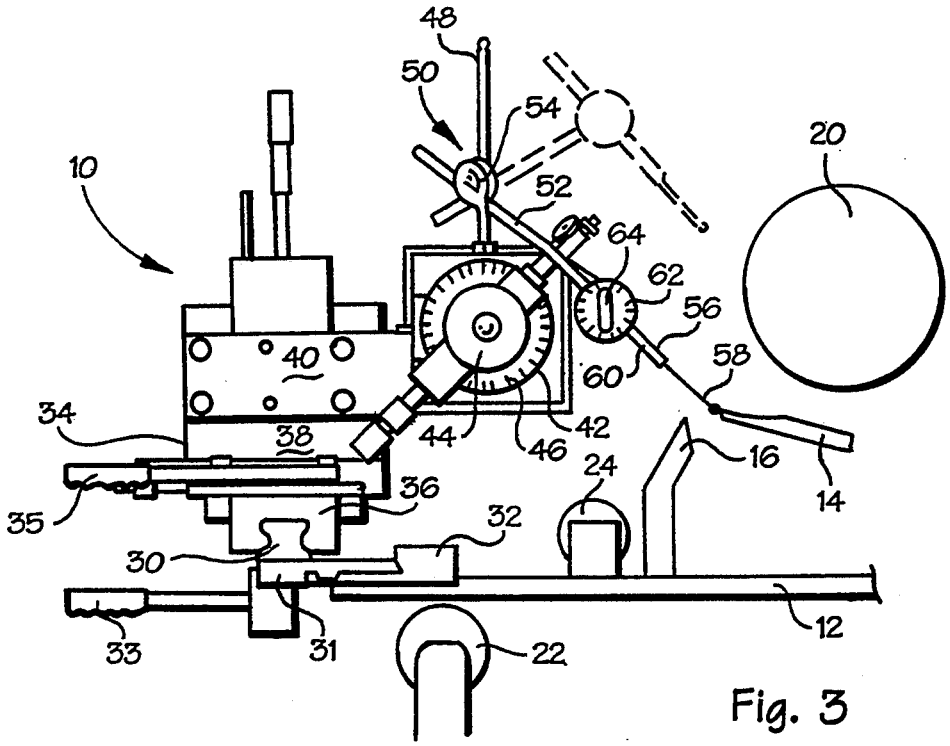
FIG. 3 is a side elevational view of the inspecting apparatus of the present invention, with its detection tool in use on the ledger blade of the shearing machine.

As shown in FIG. 3, a support staff 48 extends upwardly from the outward end of the subframe 40 for selective mounting thereto and demounting therefrom of a feeler arm assembly 50 operable for detecting irregularities in linearity or relative disposition of the ledger blade and the cloth rest. The feeler arm assembly includes a support arm 52 having an articulable mounting bracket 54 selectively positionable along its length, by which the arm 52 can be affixed to the support staff 48. A feeler tool 56 is mounted to one end of the support arm 52 by an articulable joint, e.g., a ball-and-socket joint (not shown). The feeler tool 56 may be of various conventional types, e.g., having a feeler rod 58 supported for telescoping movement within a tubular sheath 60 extending outwardly from a sensing device 62 operable to detect movements of the feeler rod 58 and visually indicate such movements on a dial gauge 64 at one face of the sensing device 62.

In operation, with the shear cylinder 20 and the ledger blade 14 pivoted upwardly out of normal operating disposition so as to be spaced from the cloth rest 16 and spaced from one another, the articulable mounting bracket 54 and the articulable joint between the feeler tool 56 and the support arm 52 enable the feeler arm assembly 50 to be selectively manipulable into a variety of differing dispositions to orient the feeler rod 58 of the feeler tool 56 for traveling surface contact with the cloth rest 16 or the ledger blade 14 during movement of the carriage 34 along the guide rail 30, whereby irregularities in the linearity of these components and any non-parallelism of these components relative to the shearing cylinder 20 can be precisely detected and corrected through the conventional adjusting mechanisms provided on the shearing machine. Importantly, the articulability of the feeler arm assembly 50 advantageously enables the linearity and parallelism of the ledger blade and the cloth rest to be checked in differing planes, e.g., by orienting the feeler rod in vertical and horizontal dispositions. The orientation of the shearing cylinder can similarly be checked. Also, with the ledger blade 14 in its operating disposition adjacent the cloth rest 16, the feeler arm assembly is enabled to check the uniformity of the spacing between the cloth rest 16 and the ledger blade 14.

Figure 4:
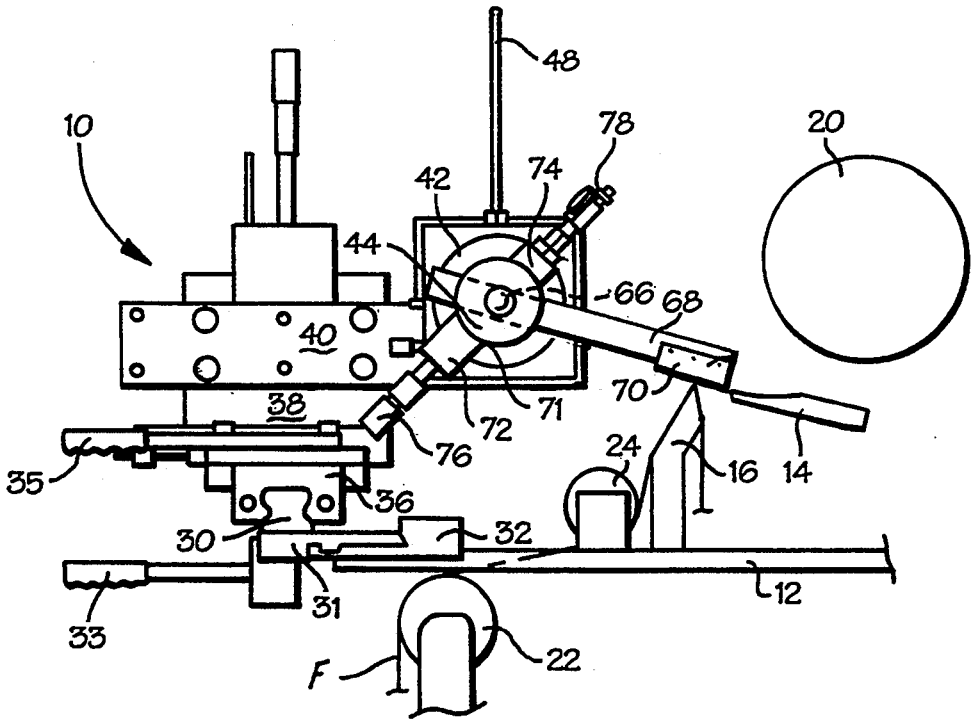
FIG. 4 is a side elevational view of the inspection apparatus, similar to FIG. 3, with its measuring tool in use.

The rotatable dial and cylindrical hub assembly 42,44 enables additional checks to be made in the indentations and dispositions of the shearing components. As seen in FIG. 4, the outer end of the cylindrical hub assembly 44 is formed with a diametric slot 66 through which a measuring arm 68 carrying a protractor device, only schematically indicated at 70, can be mounted and demounted to extend into contact with the forward side of the ledger blade 14 for purposes of measuring the angle of the cutting edge 26.

Figure 5:
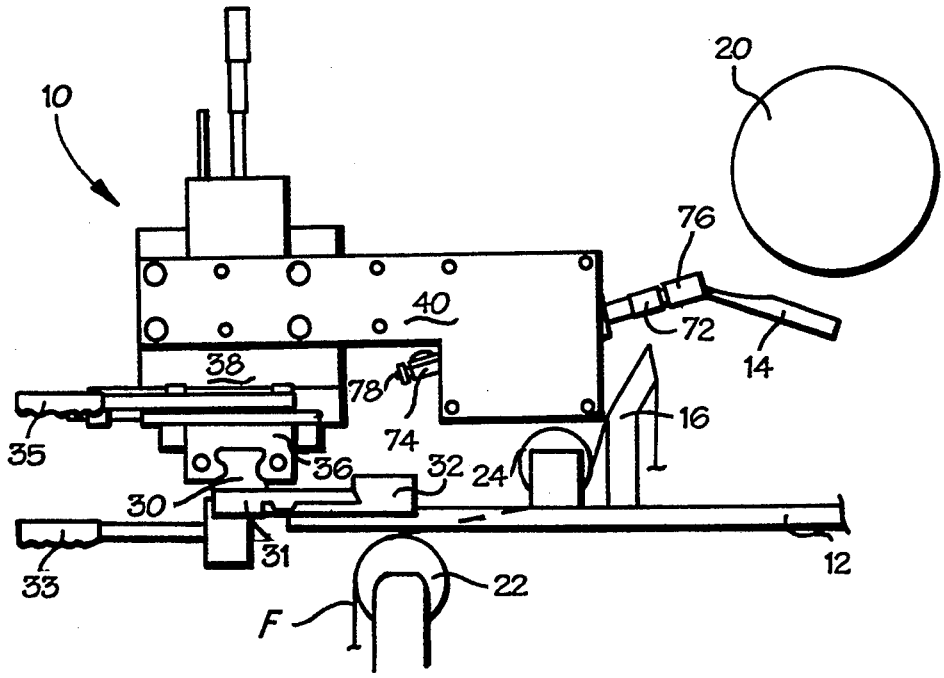
FIG. 5 is another side elevational view of the inspecting apparatus, similar to FIGS. 3 and 4, with the grinding device in use on the cutting edge of the ledger blade.

As those persons skilled in the art will recognize, it is periodically necessary and desirable to grind the forward side of the ledger blade 14 to sharpen the cutting edge 26 and, for this purpose, the cylindrical hub assembly 44 of the carriage is equipped with a grinding device 71 having a pair of radial arms 72,74 projecting from diametrically opposite sides of the cylindrical hub assembly 44, the radial arm 72 rotatably supporting a grinding wheel 76 at its outward end and the radial arm 74 having a fitting 78 for selective connection to a source of pressurized air for transmitting a driving force to the grinding wheel 76 through internal components (not shown) of the grinding device 71. The calibrations 46 on the dial 42 and subframe 40 enable the grinding angle of the grinding wheel 76 and, in turn, the angle at which the cutting edge 26 of the ledger blade 14 is sharpened, to be precisely controlled (See FIG. 5).

The apparatus 10 of the present invention may also be utilized to adjust the setting of the ledger blade 14 forwardly of its normal operating position for "lapping-in" or "backgrinding" of the shear cylinder, which is a conventional process for sharpening the shearing blades 25 by applying a grinding compound to the arcuate concave surface of the forwardly-disposed ledger blade 14 while rotating the shearing cylinder 20 in the reverse direction from its normal direction of shearing operation.

While the apparatus of the present invention has been herein illustrated and described in a preferred embodiment which is mechanically and manually operable, those persons skilled in the art will readily recognize and understand that the principles and concepts of this invention are equally applicable to more sophisticated electronically controlled devices. For example, it is contemplated that appropriate electronic sensors or detectors could be utilized instead of the feeler tool 56 and the protractor device 70 to accomplish even greater precision in detection of irregularities in and measurement of the characteristics of the shearing components of the shearing machine. Likewise, it is contemplated that the traveling movement of the carriage 34 along the guide rail 30 may be driven by means other than the handle 35, e.g., by a timing belt drive mechanism and/or through power driven components. A microprocessor or other computing device could be utilized to automatically stop the inspecting apparatus upon detection of an irregularity and to direct appropriate corrective measures. These and other adaptations and extension of the principles and concepts of the present invention are intended to be within the scope of the present invention.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a textile fabric shearing machine of the type comprising a frame, a shear cylinder rotatably mounted on the frame and having peripheral cutting blades, an elongate ledger blade stationarily mounted on the frame axially alongside the periphery of the cylinder in shear cutting relation with its cutting blades, and an elongate fabric rest stationarily mounted on the frame axially alongside the periphery of the cylinder at a lateral spacing relative to the ledger blade, apparatus for inspecting the relative dispositions of the shear cylinder, the ledger blade, and the fabric rest, the apparatus comprising a linear guide rail mounted to the frame in precise axially parallel relation to the shear cylinder, and a carriage mounted on the rail for linear movement therealong, the carriage having a detection tool selectively positionable for traveling movement along the fabric rest or the ledger blade for identifying irregularities in linearity or relative disposition to the shear roller.

2. Apparatus for inspecting the relative dispositions of the shear cylinder in a textile fabric shearing machine according to claim 1, wherein the detection tool includes an indicator for displaying a visual indicia of a detected irregularity.

3. Apparatus for inspecting the relative dispositions of the shear cylinder in a textile fabric shearing machine according to claim 1, wherein the detection tool is selectively manipulable between a plurality of differing dispositions relative to the fabric rest or the ledger blade.

4. Apparatus for inspecting the relative dispositions of the shear cylinder in a textile fabric shearing machine according to claim 3, wherein the detection tool comprises a selectively articulable arm.

5. Apparatus for inspecting the relative dispositions of the shear cylinder in a textile fabric shearing machine according to claim 1, wherein the detection tool includes an element for traveling surface contact with the fabric rest or the ledger blade.

6. Apparatus for inspecting the relative dispositions of the shear cylinder in a textile fabric shearing machine according to claim 1, wherein the guide rail is selectively mountable to and demountable from the frame.

7. Apparatus for inspecting the relative dispositions of the shear cylinder in a textile fabric shearing machine according to claim 6 and further comprising brackets mounted to the frame at opposite sides thereof and selectively matable with the guide rail for mounting and demounting thereof in axially parallel relation to the shear cylinder.

8. Apparatus for inspecting the relative dispositions of the shear cylinders in a textile fabric shearing machine according to claim 1, wherein the carriage includes a measuring tool for determining an angle of the ledger blade.

9. Apparatus for inspecting the relative dispositions of the shear cylinders in a textile fabric shearing machine according to claim 8, wherein the carriage includes calibration means for adjusting the orientation of the measuring tool.

10. Apparatus for inspecting the relative dispositions of the shear cylinders in a textile fabric shearing machine according to claim 1, wherein the carriage includes means for grinding the ledger blade.

11. Apparatus for inspecting the relative dispositions of the shear cylinders in a textile fabric shearing machine according to claim 10, wherein the grinding means comprises a rotatable grinding wheel and a drive connectable to a source of pressurized air for driving rotation of the grinding wheel.

12. Apparatus for inspecting the relative dispositions of the shear cylinders in a textile fabric shearing machine according to claim 11, wherein the carriage includes calibration means for adjusting the orientation of the grinding wheel.

* * * * *